US011781842B1

(12) United States Patent
Merems

(10) Patent No.: US 11,781,842 B1
(45) Date of Patent: Oct. 10, 2023

(54) EXTENDED RANGE PROJECTILE AND METHOD FOR PROPELLING AN EXTENDED RANGE PROJECTILE

(71) Applicant: Raytheon Company, Waltham, MA (US)

(72) Inventor: Paul A. Merems, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 17/705,912

(22) Filed: Mar. 28, 2022

(51) Int. Cl.
*F42B 10/42* (2006.01)
*F42B 15/00* (2006.01)

(52) U.S. Cl.
CPC ..... *F42B 10/42* (2013.01); *F42B 15/00* (2013.01)

(58) Field of Classification Search
CPC ..... F42B 10/42; F42B 15/00
USPC ..... 102/473
See application file for complete search history.

(56) References Cited

U.S. PATENT DOCUMENTS

| | | | | |
|---|---|---|---|---|
| 4,526,105 A | | 7/1985 | Herren, Jr. | |
| 5,014,062 A | * | 5/1991 | Schriner | F42B 12/40 102/210 |
| 5,353,711 A | * | 10/1994 | Botticelli | F42B 17/00 102/490 |
| 6,234,082 B1 | * | 5/2001 | Cros | F42B 14/02 102/520 |
| 6,981,450 B1 | * | 1/2006 | Adimari | F42B 12/60 102/527 |
| 9,823,053 B1 | | 11/2017 | Fink | |
| 11,187,506 B1 | | 11/2021 | Merems | |
| 2007/0261543 A1 | * | 11/2007 | Elder | F41B 6/006 102/501 |

FOREIGN PATENT DOCUMENTS

| | | |
|---|---|---|
| EP | 0151676 A2 | 8/1985 |
| GB | 2394029 A | 4/2004 |
| WO | 2020141290 A1 | 7/2020 |

OTHER PUBLICATIONS

International Search Report and Written Opinion for related International Application No. PCT/US2023/060809, dated May 10, 2023.

* cited by examiner

*Primary Examiner* — Samir Abdosh
(74) *Attorney, Agent, or Firm* — Renner, Otto, Boisselle & Sklar

(57) ABSTRACT

An extended range projectile includes an outer shell, a center projectile body axially moveable from a stowed position to a deployed position within the outer shell, and a pusher plate assembly variably locked to an aft end of the outer shell. The pusher plate assembly includes a check valve disposed at an aft end of the pusher plate assembly, the check valve being moveable from a closed position to an open position. In the open position of the check valve, the check valve is configured to permit entry of a gunfire pressure, created in a barrel of a gun from which the extended range projectile is configured to be projected, into the pusher plate assembly such that, when the extended range projectile exits the barrel, the gunfire pressure moves the center projectile body from the stowed position to the deployed position and propels the extended range projectile.

17 Claims, 11 Drawing Sheets

EXTENDED RANGE PROJECTILE AND METHOD FOR PROPELLING AN EXTENDED RANGE PROJECTILE

TECHNICAL FIELD

The present disclosure relates generally to extended range projectiles, and more particularly to methods of projecting extended range projectiles.

BACKGROUND

Extending the range of a projectile (e.g., an effector) projected from a gun involves many challenges and considerations. For example, increasing gun powder charges may provide some extend range benefit, but this strategy is limited due to excessive setback forces as well as maximum allowable barrel pressures within the gun. Another strategy for extending the range of an effector involves using ramjet technology to add a propulsion system to the effector. Traditional approaches to adding such a ramjet involves placing the fuel behind the subsystems within the effector (e.g., seeker, GEU, CAS, warhead, etc. . . . ). However, many effectors are limited in length due to the particular host airframe, gun systems and loading equipment with which they are used. Additionally, the ducting required for the ramjet takes up additional volume, further reducing packaging options.

SUMMARY

An improved extended range projectile (e.g., effector) is described herein. The extended range projectile includes an outer shell and a center projectile body axially moveable (translatable) within the outer shell. The projectile includes a pusher plate assembly configured to move the center projectile body from a stowed position to a deployed position within the outer shell and propel the projectile further after it has been projected from a barrel of a gun. In this manner, the extended range projectile is able to first be projected from the gun with the gunfire pressure created upon firing of the gun, and then be further propelled by the pusher plate assembly. The pusher plate assembly is variably locked to an aft end of the outer shell such that after it further propels the projectile, it can separate from the projectile so that the projectile can transform to its flight state.

According to an aspect of this disclosure, an extended range projectile includes an outer shell and a center projectile body axially moveable from a stowed position to a deployed position within the outer shell. The extended range projectile also includes a pusher plate assembly variably locked to an aft end of the outer shell. The pusher plate assembly includes a check valve disposed at an aft end of the pusher plate assembly and the check valve is moveable from a closed position to an open position. In the open position of the check valve, the check valve is configured to permit entry of a gunfire pressure, created in a barrel of a gun from which the extended range projectile is configured to be projected, into the pusher plate assembly such that, when the extended range projectile exits the barrel, the gunfire pressure moves the center projectile body from the stowed position to the deployed position and propels the extended range projectile.

According to an embodiment of any paragraph(s) of this disclosure, the pusher plate assembly further includes a cylindrical pusher plate piston axially moveable from a locking position to an unlocking position, and a hollow pusher plate barrel arranged concentrically within the cylindrical pusher plate piston. The pusher plate assembly also includes a locking assembly configured to variably lock the pusher plate assembly to the aft end of the outer shell. The locking assembly is radially moveable from a locked position to an unlocked position when the cylindrical pusher plate piston is in the unlocking position.

According to an embodiment of any paragraph(s) of this disclosure, the cylindrical pusher plate piston includes a pusher plate piston biasing member configured to bias the pusher plate piston in the locking position.

According to an embodiment of any paragraph(s) of this disclosure, the check valve is disposed within the hollow pusher plate barrel at an aft end of the hollow pusher plate barrel.

According to an embodiment of any paragraph(s) of this disclosure, the locking assembly includes a plurality of slidable locks arranged circumferentially around and extending radially outward from the cylindrical pusher plate piston. In the locked position, the plurality of slidable locks are engaged with a locking recess in the aft end of the outer shell, thereby locking the pusher plate assembly to the outer shell. In the unlocked position, the plurality of slidable locks are disengaged with the locking recess in the aft end of the outer shell, thereby unlocking the pusher plate assembly from the outer shell.

According to an embodiment of any paragraph(s) of this disclosure, the plurality of slidable locks include a plurality of ball stacks.

According to an embodiment of any paragraph(s) of this disclosure, the center projectile body includes a hollow pusher piston extending axially from an aft end of the center projectile body into the hollow pusher plate barrel of the pusher plate assembly.

According to an embodiment of any paragraph(s) of this disclosure, the hollow pusher plate barrel includes a plurality of ports extending through a wall of the hollow pusher plate barrel from an inner barrel chamber of the hollow pusher plate barrel to an outer piston chamber formed by an inner wall of the cylindrical pusher plate piston and an outer wall of the hollow pusher plate barrel.

According to an embodiment of any paragraph(s) of this disclosure, the check valve includes a valve piston, a valve seat, and a valve piston biasing member configured to bias the check valve in the closed position in which the valve piston contacts the valve seat.

According to another aspect of this disclosure, an extended range projectile includes an outer shell, and a center projectile body axially movable from a stowed position to a deployed position within the outer shell. The extended range projectile also includes a pusher plate assembly variably locked to an aft end of the outer shell, the pusher plate assembly including a firing pin assembly and an energetic cartridge. When the extended range projectile exits a barrel of a gun from which the extended range projectile is configured to be projected, the firing pin assembly is configured to strike the energetic cartridge. When the firing pin assembly strikes the energetic cartridge, the energetic cartridge is configured to generate a pressurized gas to move the center projectile body from the stowed position to the deployed position and propel the extended range projectile.

According to an embodiment of any paragraph(s) of this disclosure, the pusher plate assembly further includes a cylindrical pusher plate piston axially moveable from a locking position to an unlocking position, and a hollow pusher plate barrel arranged concentrically within the cylindrical pusher plate piston. The pusher plate assembly also includes a locking assembly configured to variably lock the pusher plate assembly to the aft end of the outer shell. The locking assembly is radially moveable from a pusher plate locked position to a pusher plate unlocked position when the cylindrical pusher plate piston is in the unlocking position.

According to an embodiment of any paragraph(s) of this disclosure, the firing pin assembly includes a firing pin locking assembly moveable from a firing pin locked position to a firing pin unlocked position. The firing pin assembly also includes a firing pin moveable, when the firing pin locking assembly is in the unlocked position, from an inert position to a cocked position and from the cocked position to a striking position.

According to an embodiment of any paragraph(s) of this disclosure, the firing pin locking assembly includes a firing pin lock piston moveable from a first position to a second position, and a firing pin lock. In the firing pin locked position, the firing pin lock piston is in the first position and the firing pin lock is engaged with a firing pin locking notch in the firing pin. In the firing pin unlocked position, the firing pin lock piston is in the second position and the firing pin lock is disengaged with the firing pin locking notch in the firing pin.

According to an embodiment of any paragraph(s) of this disclosure, the firing pin lock piston is biased in the first position with a firing pin lock piston biasing member.

According to an embodiment of any paragraph(s) of this disclosure, the center projectile body includes a hollow pusher piston extending axially from an aft end of the center projectile body into the hollow pusher plate barrel of the pusher plate assembly.

According to an embodiment of any paragraph(s) of this disclosure, the hollow pusher plate barrel includes a plurality of ports extending through a wall of the hollow pusher plate barrel from an inner barrel chamber of the hollow pusher plate barrel to an outer piston chamber formed by an inner wall of the cylindrical pusher plate piston and an outer wall of the hollow pusher plate barrel.

According to an embodiment of any paragraph(s) of this disclosure, the energetic cartridge is disposed within the hollow pusher plate barrel.

According to another aspect of this disclosure, a method of propelling an extended range projectile from a barrel of a gun includes the steps of firing the gun, and propelling the projectile out of the barrel with gunfire pressure created in the barrel upon firing the gun. The method also includes the steps of further propelling the projectile, with a pusher plate assembly variably locked to an aft end of the projectile, upon exit of the projectile out of the barrel, unlocking the pusher plate assembly from the aft end of the projectile, and separating the pusher plate assembly from the aft end of the projectile.

According to an embodiment of any paragraph(s) of this disclosure, the step of further propelling the projectile includes the step of moving a check valve disposed at an aft end of the pusher plate assembly from a closed position to an open position to permit the gunfire pressure to enter the pusher plate assembly and propel the extended range projectile.

According to an embodiment of any paragraph(s) of this disclosure, the step of further propelling the projectile includes the steps of striking an energetic cartridge of the pusher plate assembly with a firing pin of the pusher plate assembly and generating a pressurized gas from the energetic cartridge to propel the extended range projectile.

The following description and the annexed drawings set forth in detail certain illustrative embodiments described in this disclosure. These embodiments are indicative, however, of but a few of the various ways in which the principles of this disclosure may be employed. Other objects, advantages and novel features will become apparent from the following detailed description when considered in conjunction with the drawings.

BRIEF DESCRIPTION OF DRAWINGS

The annexed drawings show various aspects of the disclosure.

DETAILED DESCRIPTION

Described herein is an extended range projectile configured to be projected out of a barrel of a gun and be further propelled over an extended range as compared to traditional projectiles. Specifically, the extended range projectile includes a pusher plate assembly variably locked to an aft end of an outer shell of the projectile and configured to move a center projectile body from a stowed position to a deployed position within the outer shell and further propel the extended range projectile after it exits the barrel of the gun. The extended range projectile including the pusher plate assembly disclosed herein is advantageous over traditional projectiles and conventional extended range projectiles using ramjet technology. Specifically, the extended range projectile disclosed herein does not require as much additional volume for ramjet ducting or fuel stores as conventional ramjet projectiles.

Figure 1:
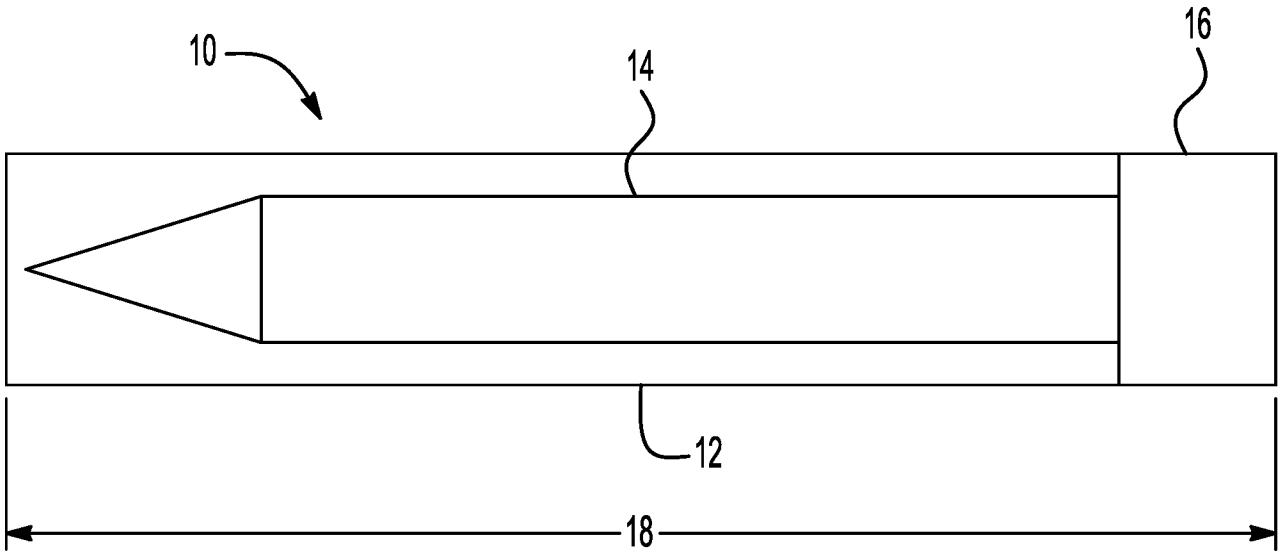
FIG. 1 is a schematic diagram of an extended range projectile.

With initial reference to FIG. 1, the extended range projectile 10 disclosed herein includes an outer shell 12, a center projectile body 14 arranged within the outer shell 12, and a pusher plate assembly 16 variably locked to an aft end of the outer shell 12. The extended range projectile 10 is configured to be projected, for example, out of a barrel of a gun (not pictured in FIG. 1). The center projectile body 14 is axially moveable (translatable along the longitudinal axis 18 of the extended range projectile 10) within the outer shell 12 from a stowed position (as depicted in FIGS. 1 and 2A) to a deployed position (depicted in FIGS. 2B-D, described below) such that the extended range projectile 10 may be compactly packaged without requiring additional space for various ramjet parts.

Figure 2A:
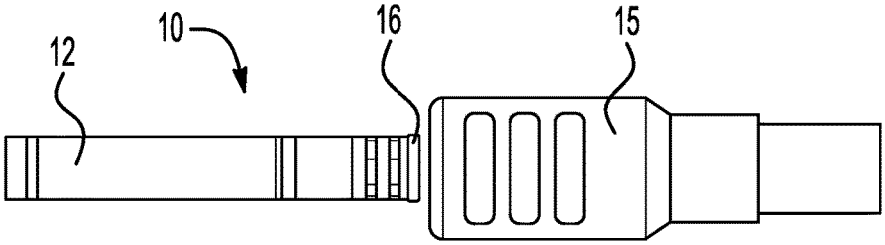
FIG. 2A is a side view of the extended range projectile of FIG. 1 after it first exits a barrel of a gun.
Figure 2B:
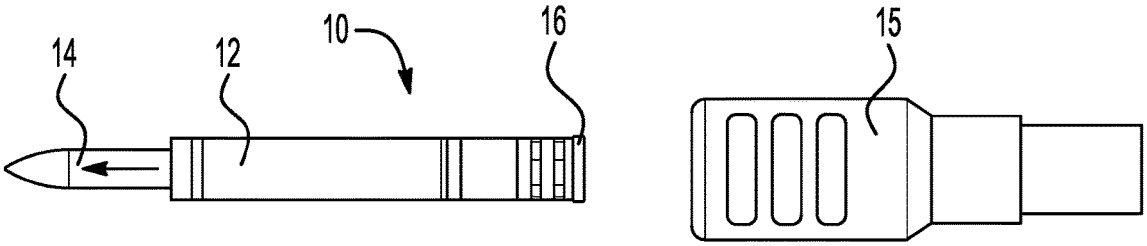
FIG. 2B is a side view of the extended range projectile of FIGS. 1 and 2A after it exits the barrel of the gun, and a center projectile body of the projectile is moved from a stowed position to a deployed position within an outer shell of the projectile.
Figure 2C:
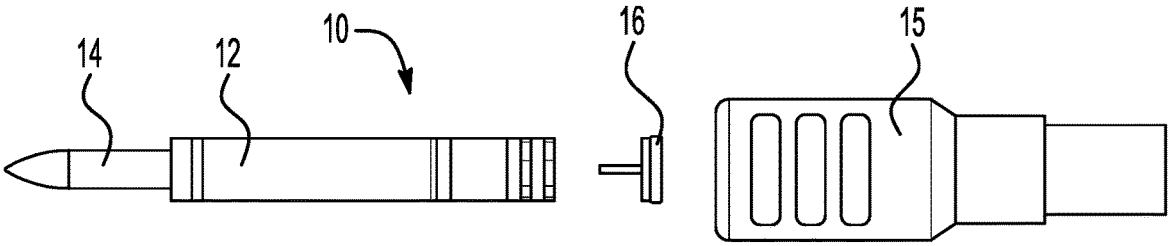
FIG. 2C is a side view of the extended range projectile of FIGS. 1-2B after it exits the barrel of the gun, and a pusher plate assembly of the projectile is separated from an aft end of the outer shell.
Figure 2D:
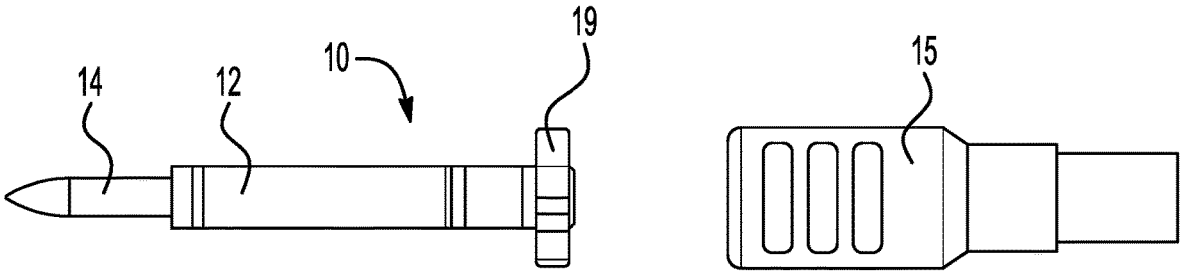
FIG. 2D is a side view of the extended range projectile of FIGS. 1-2C after it exits the barrel of the gun and is in flight.
Figure 3A:
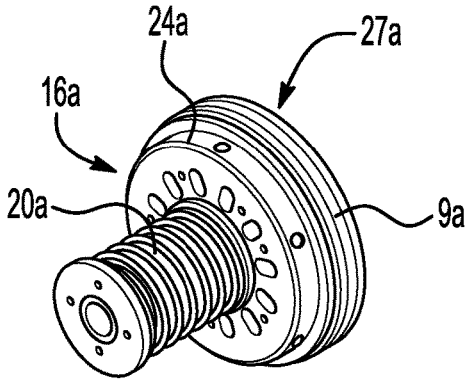
FIG. 3A is a perspective view of a pusher plate assembly according to an embodiment of the extended range projectile.
Figure 3B:
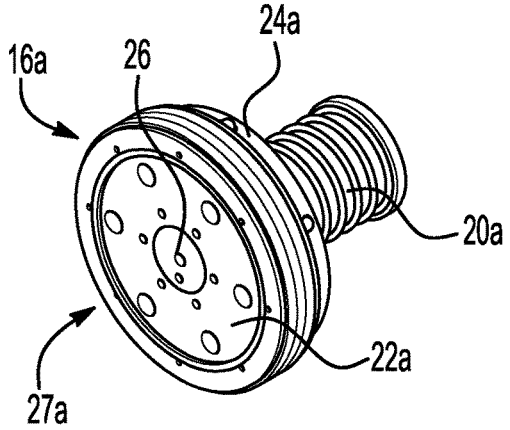
FIG. 3B is another perspective view of the pusher plate assembly of FIG. 3A.
Figure 4:
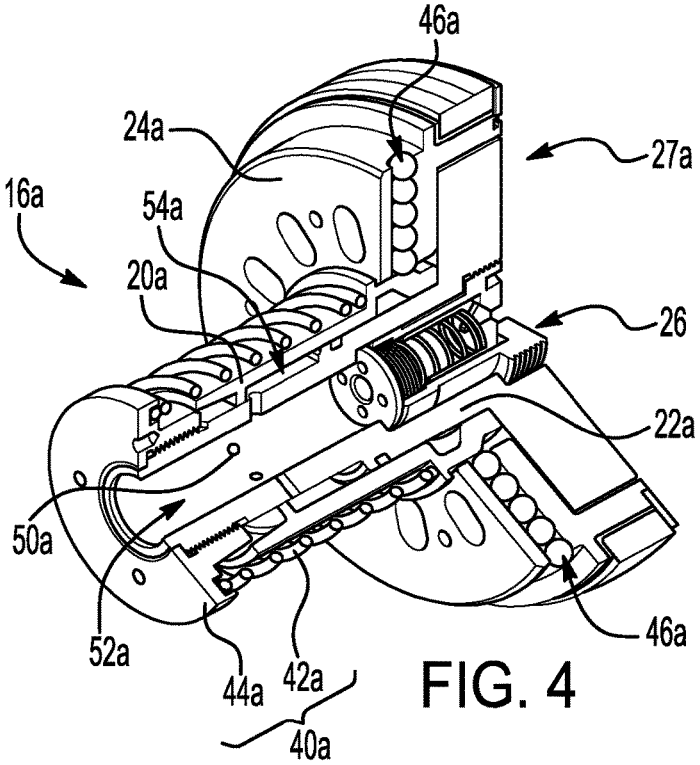
FIG. 4 is a cross-sectional perspective view of the pusher plate assembly of FIGS. 3A and 3B.

With reference to the sequence depicted in FIGS. 2A-2D, the movement of the center projectile body 14 within the outer shell 12 from the stowed position (FIGS. 1 and 2A) to the deployed position (FIGS. 2B-2D) is depicted. The center projectile body 14 of the extended range projectile 10 is configured to be in the stowed position for transport and handling and for loading into the gun prior to firing the gun. Once the gun is fired and the aft end of the projectile 10 exits the barrel 15 of the gun, the center projectile body 14 is configured to move (translate) from the stowed position to the deployed position. Specifically, FIG. 2A depicts the extended range projectile 10 in the stowed position as it begins to exit a barrel 15 of a gun. As will be described in more detail below, by action of the pusher plate assembly 16 of the projectile 10, as soon as the aft end of the projectile exits the barrel 15, the center projectile body 14 moves from the stowed position (FIGS. 1 and 2A) to the deployed position depicted in FIG. 2B. Thereafter, as depicted in FIG. 2C, the pusher plate assembly 16 is configured to unlock and separate from the aft end of the outer shell 12 of the projectile 10. FIG. 2D depicts the projectile 10 in a flight state, with the pusher plate assembly 16 separated. For example, in the flight state, one or more fins 19 of the projectile 10 may be deployed. That is, the pusher plate assembly 16 may be configured to trap the one or more fins 19 of the projectile in a stowed position when the pusher plate assembly 16 is locked to the outer shell 12, and release the one or more fins 19 when the pusher plate assembly 16 is unlocked and separated from the outer shell 12, thereby allowing the one or more fins 19 to move from their stowed position to their deployed position depicted in FIG. 2D.

The details of a first embodiment of a pusher plate assembly 16*a* will be described with reference to FIGS. 3A-6F. With initial reference to FIGS. 3A, 3B, and 4, the pusher plate assembly 16*a* includes a cylindrical pusher plate piston 20*a*, a hollow pusher plate barrel 22*a* arranged concentrically within the cylindrical pusher plate piston 20*a*, a locking assembly 24*a*, and a check valve 26. As depicted in FIGS. 6A-F, the center projectile body 14 includes a hollow pusher piston 17 extending axially away from an aft end of the center projectile body 14. When the pusher plate assembly 16*a* is locked to the aft end of the outer shell 12, the hollow pusher piston 17 is configured to extend concentrically into the hollow pusher plate barrel 22*a* of the pusher plate assembly 16*a*. The pusher plate assembly 16*a* may additionally include a slipping obturator 9*a* arranged circumferentially around an aft end of the pusher plate assembly 16*a*.

Figure 5:
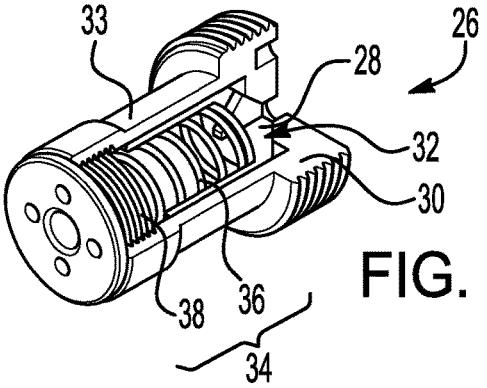
FIG. 5 is a cross-sectional perspective view of a check valve of the pusher plate assembly of FIGS. 3A-4.

The check valve 26 is disposed at an aft end 27*a* of the pusher plate assembly 16*a*. Specifically, the check valve 26 is disposed within the hollow pusher plate barrel 20*a* at an aft end of the hollow pusher plate barrel 20*a*. The check valve 26 is moveable from a closed position to an open position. FIG. 5 depicts the check valve 26 in isolation. The check valve 26 includes a valve piston 28, a valve seat 30, and a valve piston biasing member 34. The valve seat 30 includes a valve seat surface 32 against which the valve piston 28 is configured to variably contact, and a hollow valve seat shaft 33 within which the valve piston 28 and valve piston biasing member 34 are disposed. The valve piston biasing member 34 may include, for example, a spring 36 and a spring base 38. The spring base 38 may be threadedly engaged with a first end of the hollow valve seat shaft 33 to hold the spring base 38 stationary such that it can support the spring 36. A second end of the hollow valve seat shaft 33 may be threadedly engaged with the aft end of the hollow pusher plate barrel 22*a* to hold the check valve 26 therewithin. The spring 36 of the valve piston biasing member 34 is configured to bias the check valve 26 in the closed position. In the closed position of the check valve 26, the valve piston 28 contacts the valve seat surface 32 of the valve seat 30 and in the open position of the check valve 26, the valve piston 28 is spaced apart from the valve seat surface 32 of the valve seat 30. That is, in the open position of the check valve 26, a biasing force of the spring 36 of the valve piston biasing member 34 is overcome such that the spring 36 is compressed and the valve piston 28 is separated from the valve seat surface 32 of the valve seat 30.

Figure 6A:
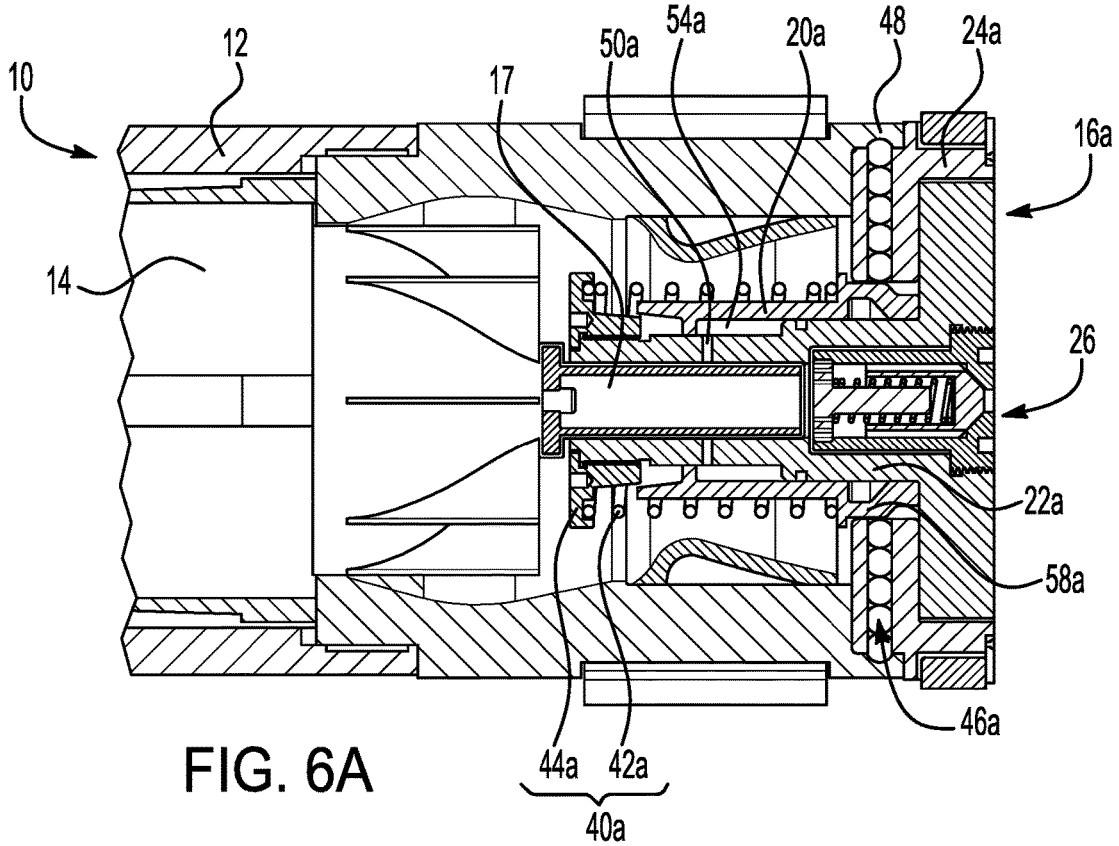
FIG. 6A is a partial cross-sectional view of the extended range projectile having the pusher plate assembly of FIGS. 3A-4 before the gun is fired.
Figure 6B:
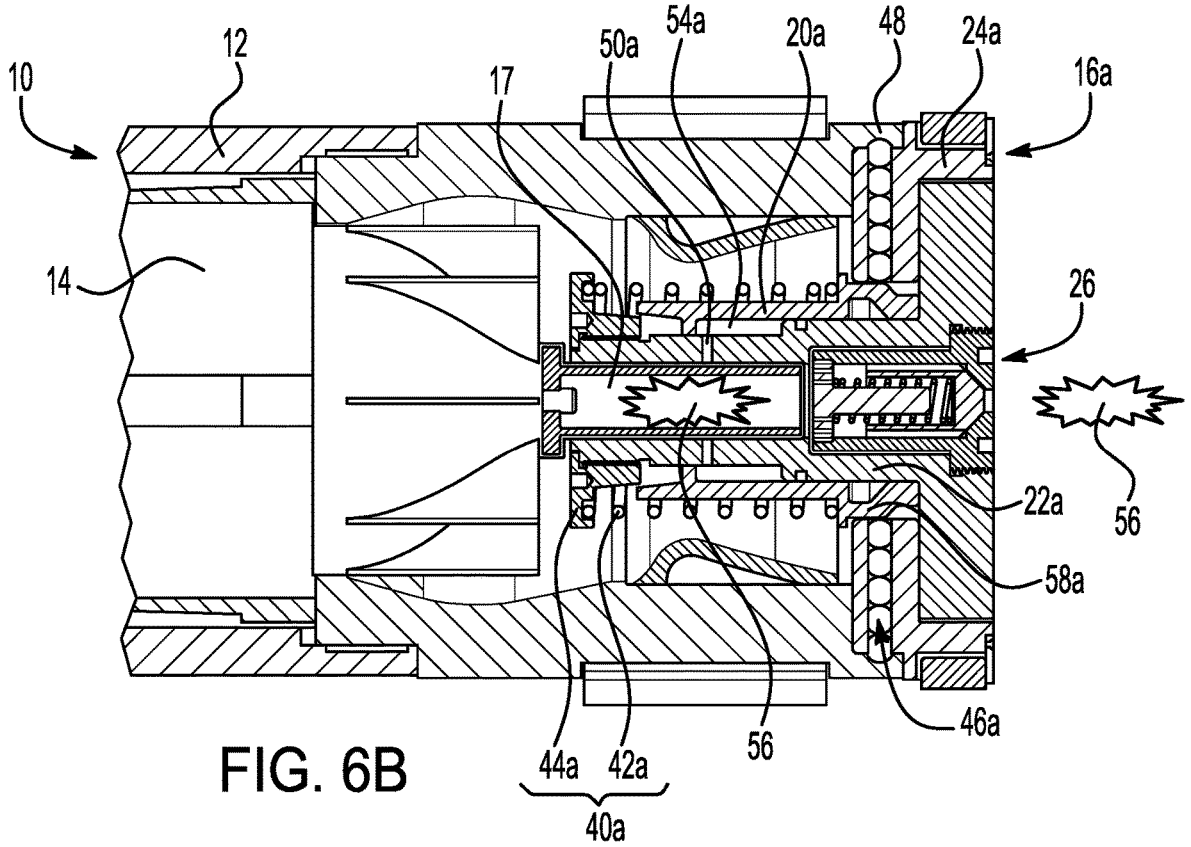
FIG. 6B is a partial cross-sectional view of the extended range projectile having the pusher plate assembly of FIGS. 3A-4 after the gun is fired and before the projectile exits the barrel of the gun.
Figure 6C:
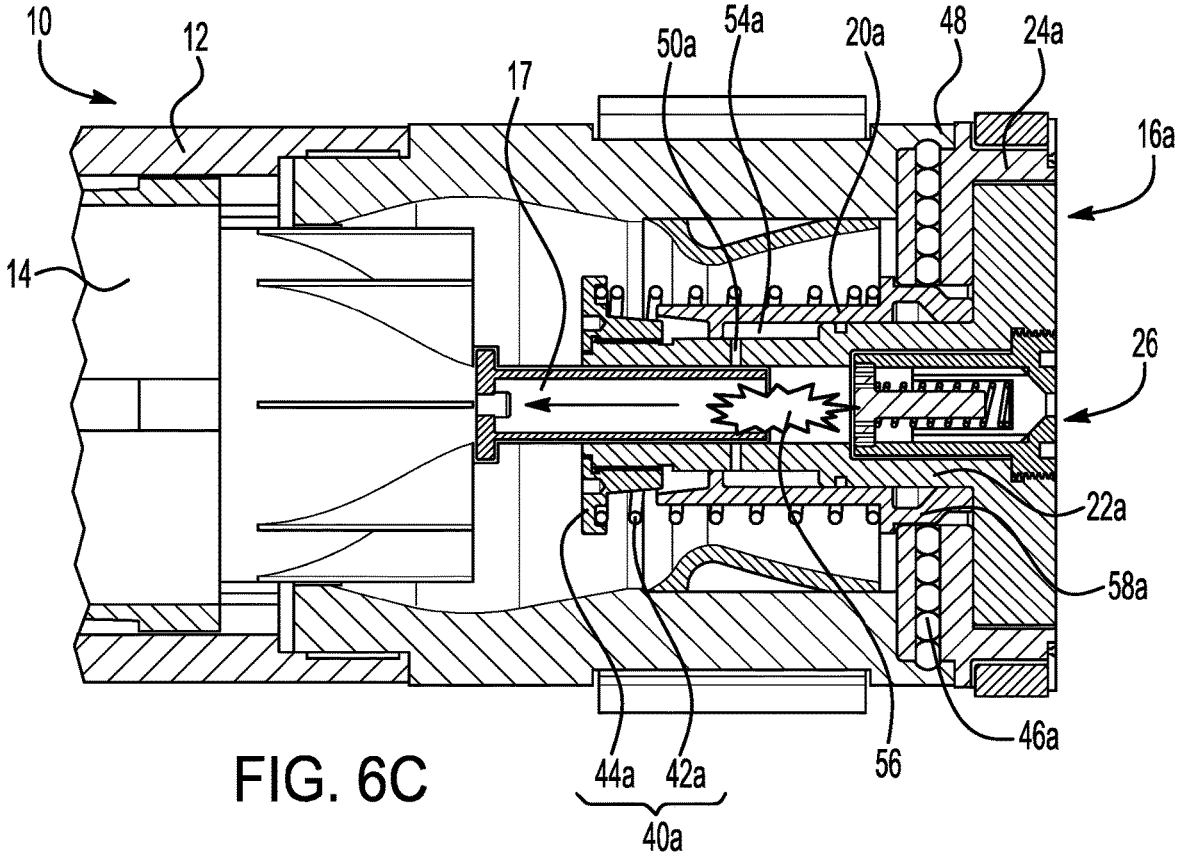
FIG. 6C is a partial cross-sectional view of the extended range projectile having the pusher plate assembly of FIGS. 3A-4 after the projectile first exits the barrel of the gun.
Figure 6D:
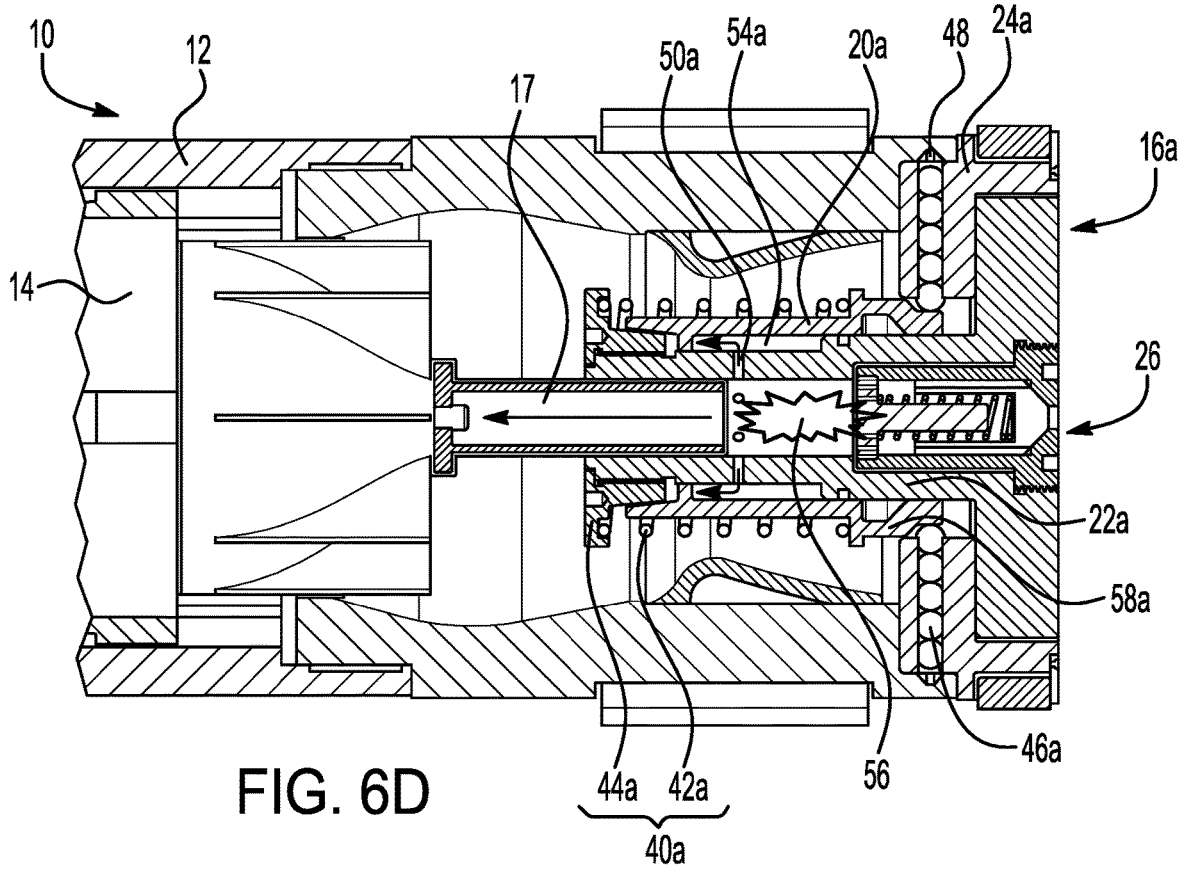
FIG. 6D is a partial cross-sectional view of the extended range projectile having the pusher plate assembly of FIGS. 3A-4 after the projectile exits the barrel of the gun and the pusher plate assembly is unlocked from the aft end of the outer shell.
Figure 6E:
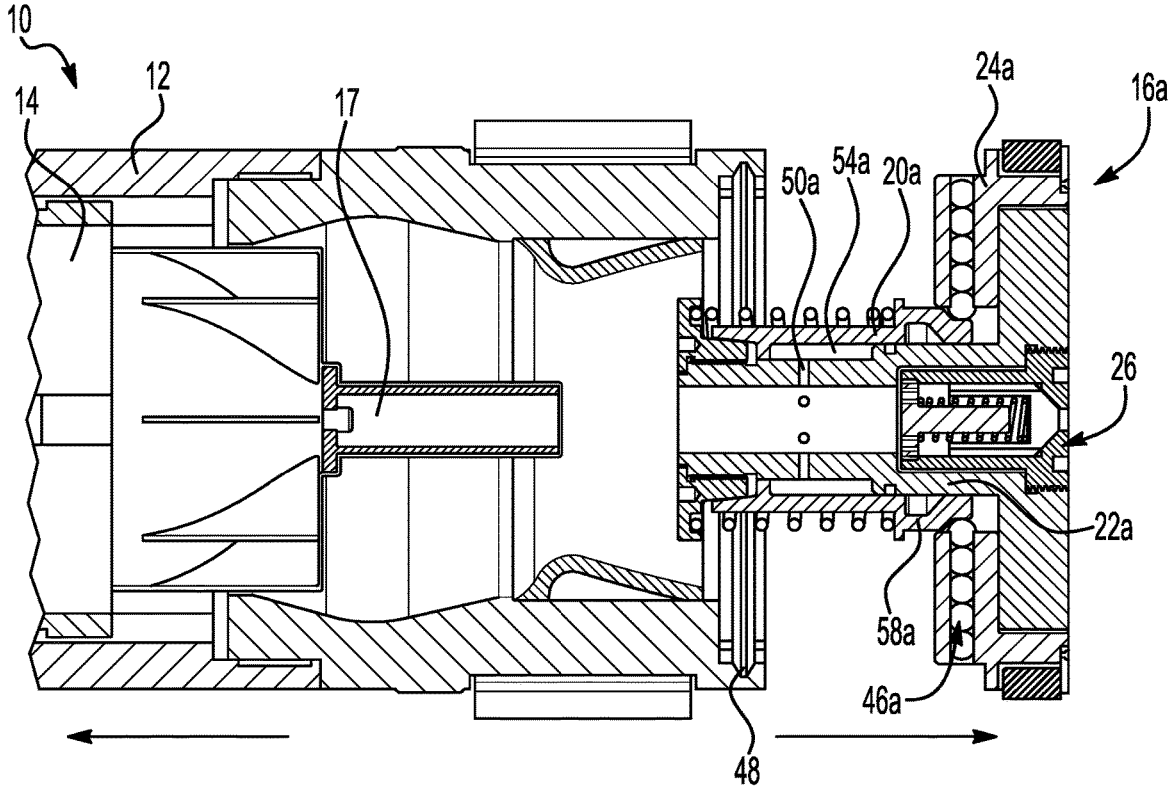
FIG. 6E is a partial cross-sectional view of the extended range projectile having the pusher plate assembly of FIGS. 3A-4 after the projectile exits the barrel of the gun and the pusher plate assembly is separated from the aft end of the outer shell.

Referring back to FIG. 4, as well as to FIGS. 6A-E, the cylindrical pusher plate piston 20*a* of the pusher plate assembly 16*a* is axially moveable from a locking position (FIGS. 4, 6A, 6B, 6C) to an unlocking position (FIGS. 6D, 6E). The cylindrical pusher plate piston 20*a* includes a pusher plate piston biasing member 40*a* configured to bias the pusher plate piston 20*a* in the locking position (FIGS. 4, 6A, 6B, 6C). The pusher plate piston biasing member 40*a* may include, for example a spring 42*a*, and a spring base 44. The spring base 44 may be threadedly engaged to a first end of the hollow pusher plate barrel 22*a* to hold the spring base 44 stationary such that it can support the spring 42*a*.

The locking assembly 24*a* of the pusher plate assembly 16*a* is configured to variably lock the pusher plate assembly 16*a* to the aft end of the outer shell 12. Specifically, the locking assembly 24*a* is radially moveable from a locked position (FIGS. 4, 6A, 6B, 6C) to an unlocked position (FIGS. 6D, 6E) when the cylindrical pusher plate piston 20*a* is in the unlocking position (FIGS. 6D, 6E). For example, the locking assembly 24*a* may include a plurality of slidable locks 46*a* arranged circumferentially around and extending radially outward from the cylindrical pusher plate piston 20*a*. In the locked position of the locking assembly 24*a* (FIGS. 4, 6A, 6B, 6C), the plurality of slidable locks 46*a* are engaged with a locking recess 48 in the aft end of the outer shell 12 (FIGS. 6A, 6B, 6C), thereby locking the pusher plate assembly 16*a* to the outer shell 12. In the unlocked position (FIGS. 6D, 6E), the plurality of slidable locks 46*a* are disengaged with the locking recess 48 in the aft end of the outer shell 12 (FIGS. 6D, 6E), thereby unlocking the pusher plate assembly 16*a* from the outer shell 12. The plurality of slidable locks 46*a* may be, for example, a plurality of ball stack locks, as depicted. The plurality of ball stack locks may include a plurality of balls with or without a cylinder disposed between a first end ball and a second end ball. The particular types of slidable locks 46*a* described herein are provided as non-limiting examples, and it is understood that other types of slidable locks may be applicable to the locking assembly 24*a* disclosed herein.

The hollow pusher plate barrel 22*a* of the pusher plate assembly 16*a* includes a plurality of ports 50*a* extending through a wall of the hollow pusher plate barrel 22*a* from an inner barrel chamber 52*a* of the hollow pusher plate barrel 22*a* to an outer piston chamber 54*a* formed by an inner wall of the cylindrical pusher plate piston 20*a* and an outer wall of the hollow pusher plate barrel 22*a*. That is, the cylindrical pusher plate piston 20*a* is configured to be spaced apart from the hollow pusher plate barrel 22*a* disposed concentrically therewithin at least in an area immediately surrounding the plurality of ports 50*a*. The cylindrical pusher plate piston 20*a*, however, is fixed to and contacts the outer wall of the hollow pusher plate barrel 22*a* on a first side of the plurality of ports 50*a* and on a second side of the plurality of ports 50*a*, such that the outer piston chamber 54*a* is formed where the cylindrical pusher plate piston 20*a* is spaced apart from the hollow pusher plate barrel 22*a*, around the plurality of ports 50*a*.

Operation of the first embodiment of the pusher plate piston 16*a* will now be described with reference to sequential FIGS. 6A-F. FIG. 6A depicts the arrangement of the extended range projectile 10 having the center projectile body 14 in its stowed position as the projectile 10 is being transported, handled and loaded into the gun prior to firing the gun. In this position, the hollow pusher piston 17 of the center projectile body 14 extends concentrically into the hollow pusher plate barrel 22*a* of the pusher plate assembly 16*a*, covering and blocking the plurality of ports 50*a*. The check valve 26 is in the closed position, being biased in the closed position by the valve piston biasing member 34. Additionally, the pusher plate piston 16*a* is locked to the aft end of the outer shell 12 of the extended range projectile 10. That is, the cylindrical pusher plate piston 20*a* is in the locking position, being biased in the locking position by the pusher plate piston biasing member 40*a*, and the plurality of slidable locks 46*a* are engaged with the locking notch 48 in the aft end of the outer shell 12.

FIG. 6B depicts the arrangement of the extended range projectile 10 when the gun from which it is configured to be projected is fired. When the gun is fired, a gunfire pressure 56 is created in the barrel 15 of the gun. The gunfire pressure 56 may be in the range of 50 kilopound per square inch (ksi) to 70 ksi. The check valve 26 is configured to move from the closed position (FIG. 6A) to the open position (FIG. 6B) upon force of the gunfire pressure 56. That is, the gunfire pressure 56 is sufficient to overcome the biasing force of the valve piston biasing member 34 such that the spring 36 of the valve piston biasing member 34 is compressed and the valve piston 28 is separated from the valve seat surface 32 of the valve seat 30. When the check valve 26 is in this open position, the check valve 26 is configured to permit entry of the gunfire pressure 56 into the pusher plate assembly 16*a*. Specifically, the gunfire pressure 56 enters through the check valve 26 into the hollow pusher piston 17 of the center projectile body 14 arranged concentrically in the hollow pusher plate barrel 22*a* of the pusher plate assembly 16*a*. Due to a setback force within the barrel 15 of the gun, before the aft end of the projectile 10 exits the barrel 15 of the gun, the gunfire pressure 56 is not sufficient to move the center projectile body 14, and instead builds up within the hollow pusher piston 17. The setback force may have a g-force around 18,000 g's.

FIG. 6C depicts the arrangement of the extended range projectile 10 as soon as the aft end of the extended range projectile 10 exits the barrel 15 of the gun. As soon as the aft end of the projectile 10 exits the barrel 15 of the gun, the setback force is removed and the gunfire pressure 56 built up in the hollow pusher piston 17 begins to move the center projectile body 14 from the stowed position toward the deployed position. Once the hollow pusher piston 17 is moved far enough to expose the plurality of ports 50*a* in the hollow pusher plate barrel 22*a*, as depicted in FIG. 6D, the plurality of ports 50*a* are configured to permit the gunfire pressure 56 to move from the inner barrel chamber 52*a* of the hollow pusher plate barrel 22*a* to the outer piston chamber 54*a*. The gunfire pressure 56 in the outer piston chamber 54*a* is sufficient to move the cylindrical pusher plate piston 20*a* from the locking position (FIGS. 6A, 6B, 6C) to the unlocking position (FIGS. 6D, 6E). Specifically, the gunfire pressure 56 is sufficient to overcome the biasing force of the pusher plate piston biasing member 40*a* such that the spring 42*a* of the pusher plate biasing member 40*a* is compressed and the cylindrical pusher plate piston 20*a* moves from the locking position to the unlocking position.

When the cylindrical pusher plate piston 20*a* is in the unlocking position, the locking assembly 24*a* is configured to move from the locked position (FIGS. 6A, 6B, 6C) to the unlocked position (FIGS. 6D, 6E). Specifically, the cylindrical pusher plate piston 20*a* includes a stepped projection 58*a* extending radially outward from the cylindrical pusher plate piston 20*a*. In the locking position of the cylindrical pusher plate piston 20*a*, the stepped projection 58*a* supports the plurality of slidable locks 46*a* of the locking assembly 24*a* in the locked position, in which the plurality of slidable locks 46*a* are engaged with the locking recess 48 in the outer shell 12. However, when the cylindrical pusher plate piston 20*a* is moved from the locking position to the unlocking position, the stepped projection 58*a* moves and no longer supports the plurality of slidable locks 46*a* of the locking assembly 24*a* in the locked position. The plurality of slidable locks 46*a* are therefore free to move from the locked position to the unlocked position, in which the plurality of slidable locks 46*a* are disengaged with the locking recess 48 of the outer shell 12, as depicted in FIG. 6D.

Figure 6F:
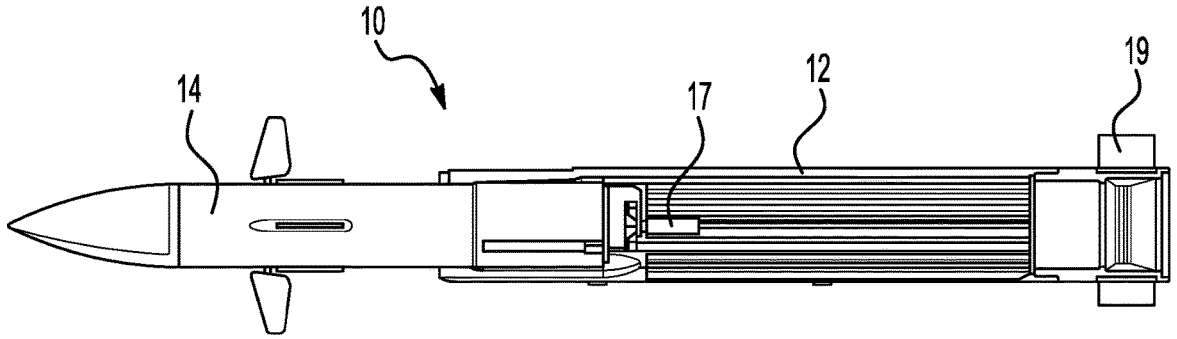
FIG. 6F is a partial cross-sectional view of the extended range projectile in flight.

Accordingly, as depicted in FIG. 6E, the pusher plate assembly 16*a* is unlocked from the aft end of the outer shell 12 and separates from the aft end of the outer shell 12, as the gunfire pressure moves the center projectile body 14 fully to the deployed position and further propels the center projectile body 14 and the outer shell 12 of the projectile 10. Once the pusher plate assembly 16*a* is separated from the aft end of the outer shell 12, the projectile 10 transforms to its flight state, in which one or more fins 19 are deployed. FIG. 6F depicts the extended range projectile 10 in the flight state.

Figure 7A:
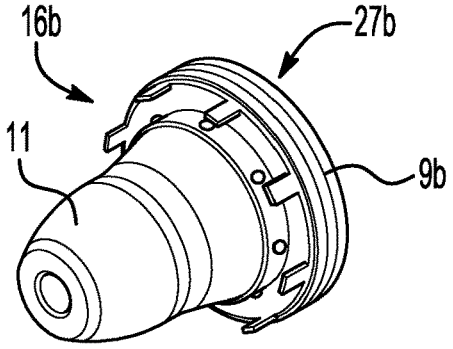
FIG. 7A is a perspective view of a pusher plate assembly according to another embodiment of the extended range projectile.
Figure 7B:
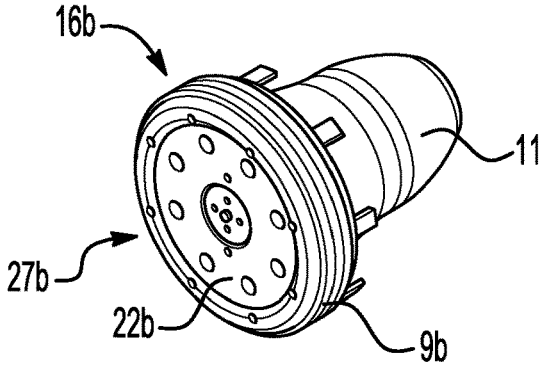
FIG. 7B is another perspective view of the pusher plate assembly of FIG. 7A.
Figure 8:
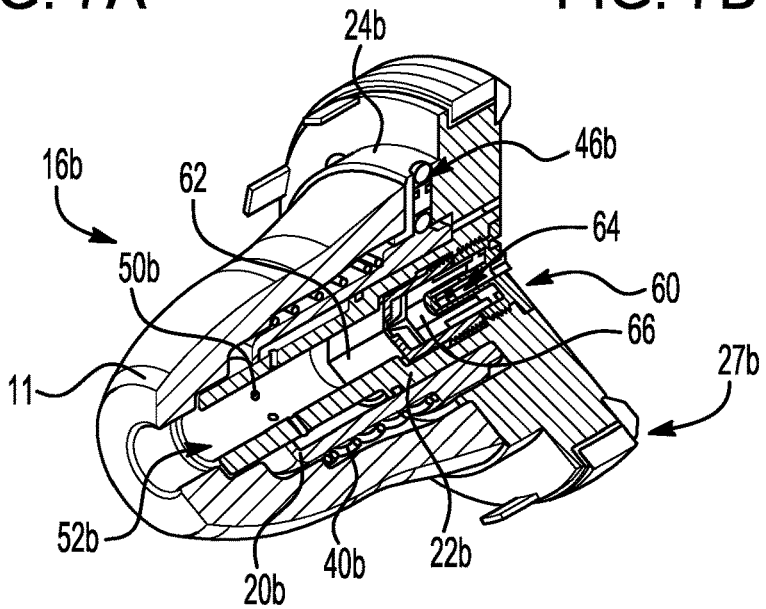
FIG. 8 is a cross-sectional perspective view of the pusher plate assembly of FIGS. 7A and 7B.

Turning to FIGS. 7A-10F, the details of a second embodiment of a pusher plate assembly 16*b* will be described. With initial reference to FIGS. 7A, 7B, and 8, the pusher plate assembly 16*b* includes a cylindrical pusher plate piston 20*b*, a hollow pusher plate barrel 22*b* arranged concentrically within the cylindrical pusher plate piston 20*b*, and a locking assembly 24*b*. The cylindrical pusher plate piston 20*b*, the hollow pusher plate barrel 22*b* and the locking assembly 24*b* may be the same as the cylindrical pusher plate piston 20*a*, the pusher plate barrel 22*a*, and the locking assembly 24*a* described above. As depicted in FIGS. 10A-F, the center projectile body 14 includes the hollow pusher piston 17 extending axially away from the aft end of the center projectile body 14. When the pusher plate assembly 16*b* is locked to the aft end of the outer shell 12, the hollow pusher piston 17 is configured to extend concentrically into the hollow pusher plate barrel 22*b* of the pusher plate assembly 16*b*. The pusher plate assembly 16*b* may also include a slipping obturator 9*b* arranged circumferentially around an aft end of the pusher plate assembly 16*b* and a pusher plate support 11 arranged at a fore end of the pusher plate assembly 16*b*. The pusher plate support 11 may form an enclosing housing around at least part of the pusher plate assembly 16*b*, as depicted in FIGS. 7A, 7B and 8.

Instead of employing a check valve, like the check valve 26 of the pusher plate assembly 16*a*, the pusher plate assembly 16*b* includes a firing pin assembly 60 and an energetic cartridge 62. The firing pin assembly 60 is disposed at an aft end 27*b* of the pusher plate assembly 16*b*. Specifically, the firing pin assembly 60 is disposed within the hollow pusher plate barrel 22*b* at an aft end of the hollow pusher plate barrel 22*b*. For example, the firing pin assembly 60 may be threadedly engaged with the aft end of the hollow pusher plate barrel 22*b*. The energetic cartridge 62 may be disposed within the hollow pusher plate barrel 22*b* at a fore end of the firing pin assembly 60. The energetic cartridge 62 may be similar to a gun cartridge with a primer.

Figure 9:
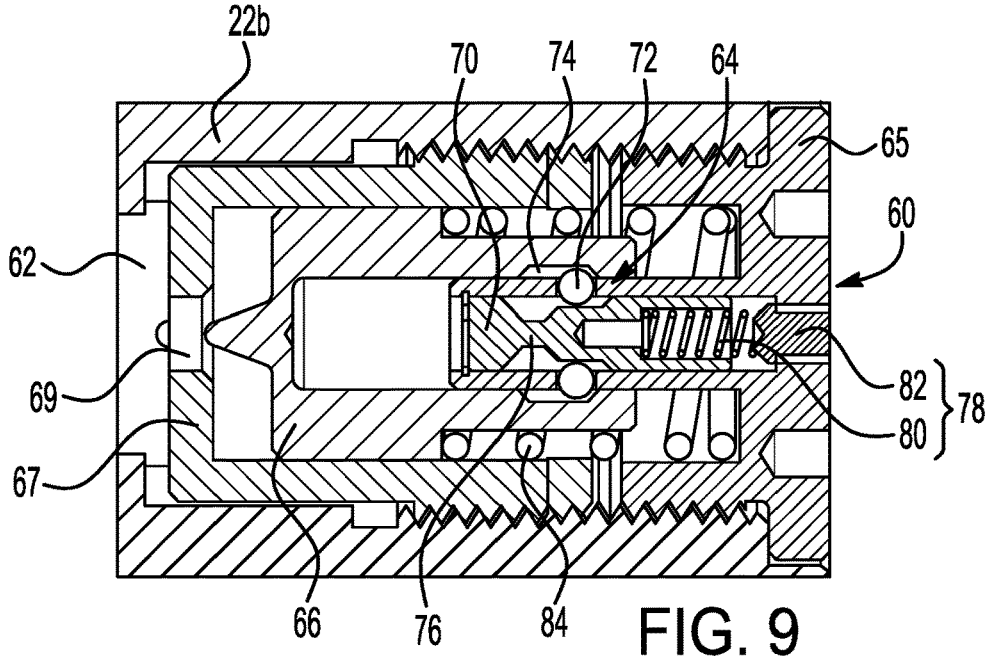
FIG. 9 is a cross-sectional view of a firing pin assembly of the pusher plate assembly of FIGS. 7A-8.

FIG. 9 depicts the firing pin assembly 60 in isolation. The firing pin assembly 60 includes a firing pin locking assembly 64 moveable from a firing pin locked position (FIGS. 9 and 10A) to a firing pin unlocked position (FIGS. 10B-F). The firing pin assembly 60 also includes a firing pin 66. The firing pin locking assembly 64 may be disposed within a firing pin locking assembly housing 65 and the firing pin 66 may be disposed within a firing pin housing 67. The firing pin housing 67 may include a firing pin hole 69 at a fore end of the firing pin housing 67 through which the firing pin 66 is configured to strike the energetic cartridge 62. The firing pin locking assembly housing 65 and the firing pin housing 67 may, for example, be separate and respectively threadedly engaged with the aft end of the hollow pusher plate barrel 22*b*, as depicted in FIG. 9.

The firing pin locking assembly 64 includes a firing pin lock piston 70 moveable from a first position (FIGS. 9 and 10A) to a second position (FIGS. 10B-F), and a firing pin lock 72. In the firing pin locked position (FIGS. 9 and 10A), the firing pin lock piston 70 is in the first position and the firing pin lock 72 is engaged with a firing pin locking notch 74 in the firing pin 66. Conversely, in the firing pin unlocked position (FIGS. 10B-F), the firing pin lock piston 70 is in the second position and the firing pin lock 72 is disengaged with the firing pin locking notch 74 in the firing pin 66. The firing pin lock 72 may be, for example, a set of lock balls. In the first position of the firing pin lock piston 70, the firing pin lock 72 is arranged around the firing pin lock piston 70 on a radially outer circumference thereof. In the second position of the firing pin lock piston 70, the firing pin lock 72 is arranged in a firing pin lock piston notch 76 formed on the outer surface of the firing pin lock piston 70 such that it is arranged around a radially inner circumference thereof. The firing pin lock piston 70 is biased in the first position with a firing pin lock piston biasing member 78. The firing pin lock piston biasing member 78 may include a spring 80 and a spring base 82. The spring base 82 may be fixed to the firing pin locking assembly housing 65 such that it can support the spring 80 therewithin.

Figure 10A:
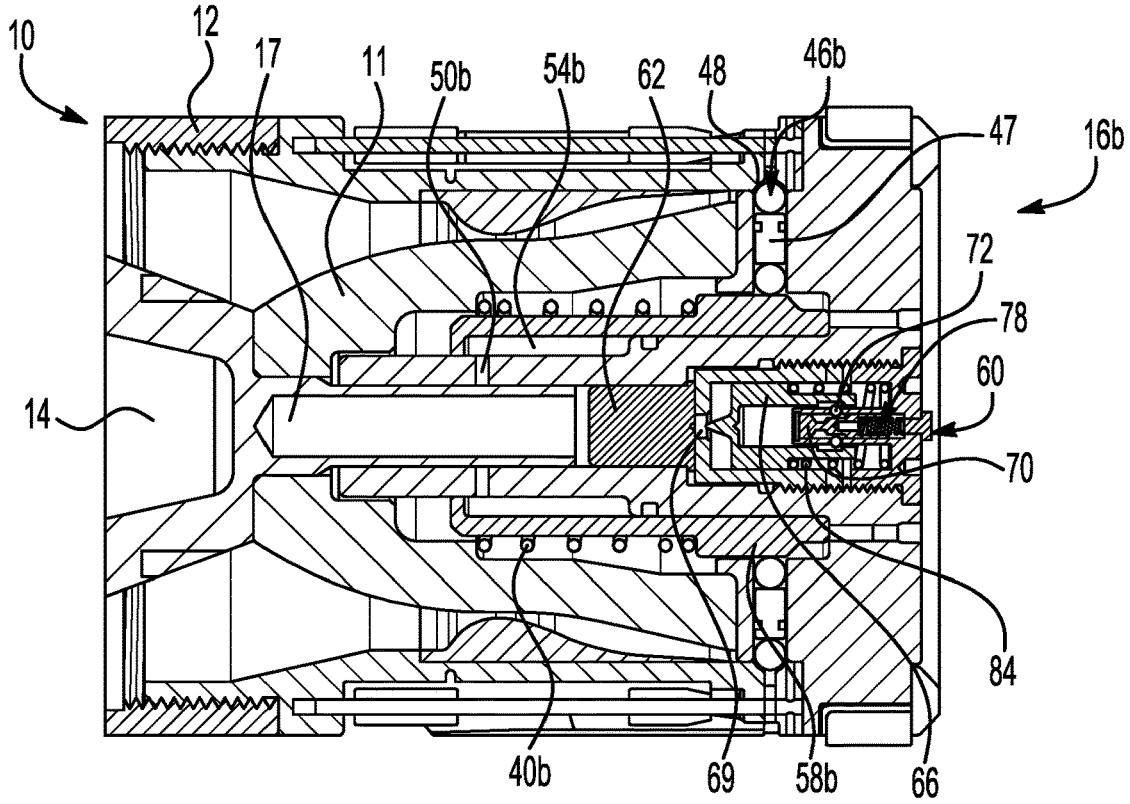
FIG. 10A is a partial cross-sectional view of the extended range projectile having the pusher plate assembly of FIGS. 7A-8 before the gun is fired.
Figure 10B:
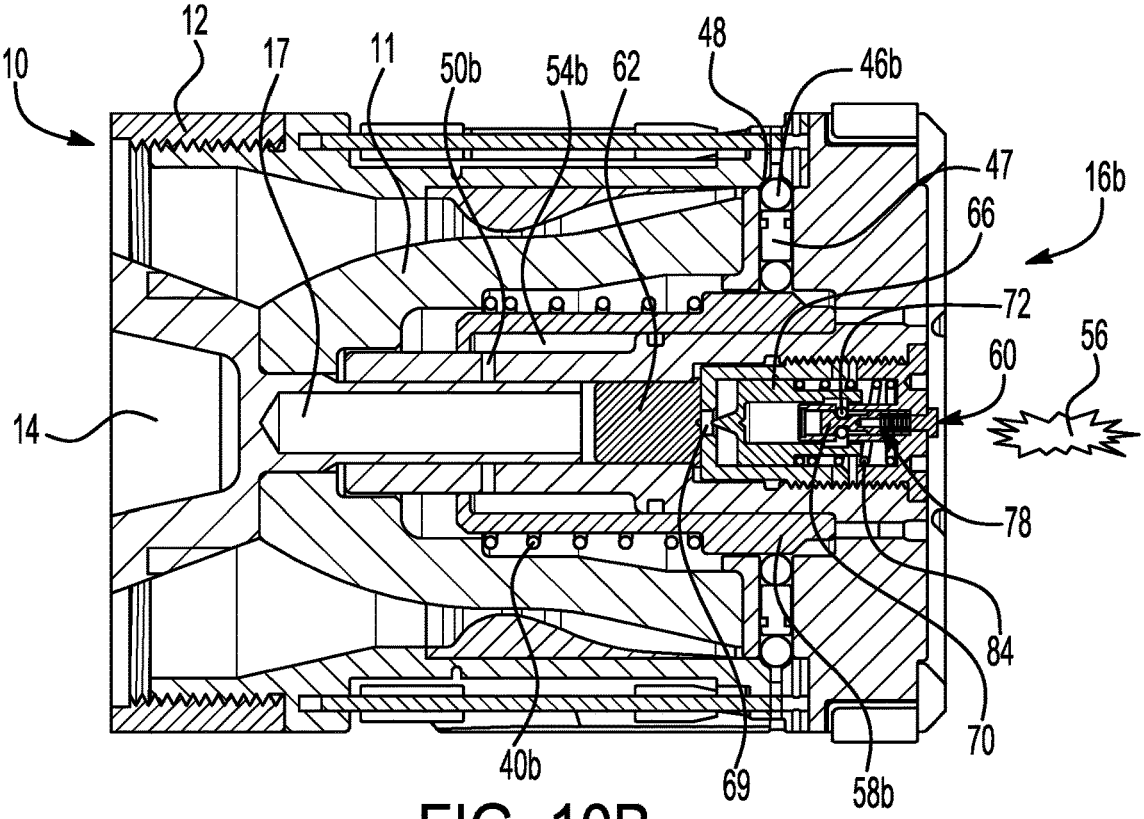
FIG. 10B is a partial cross-sectional view of the extended range projectile having the pusher plate assembly of FIGS. 7A-8 after the gun is fired and before the projectile exits the barrel of the gun, with the firing pin assembly in an unlocked position.
Figure 10C:
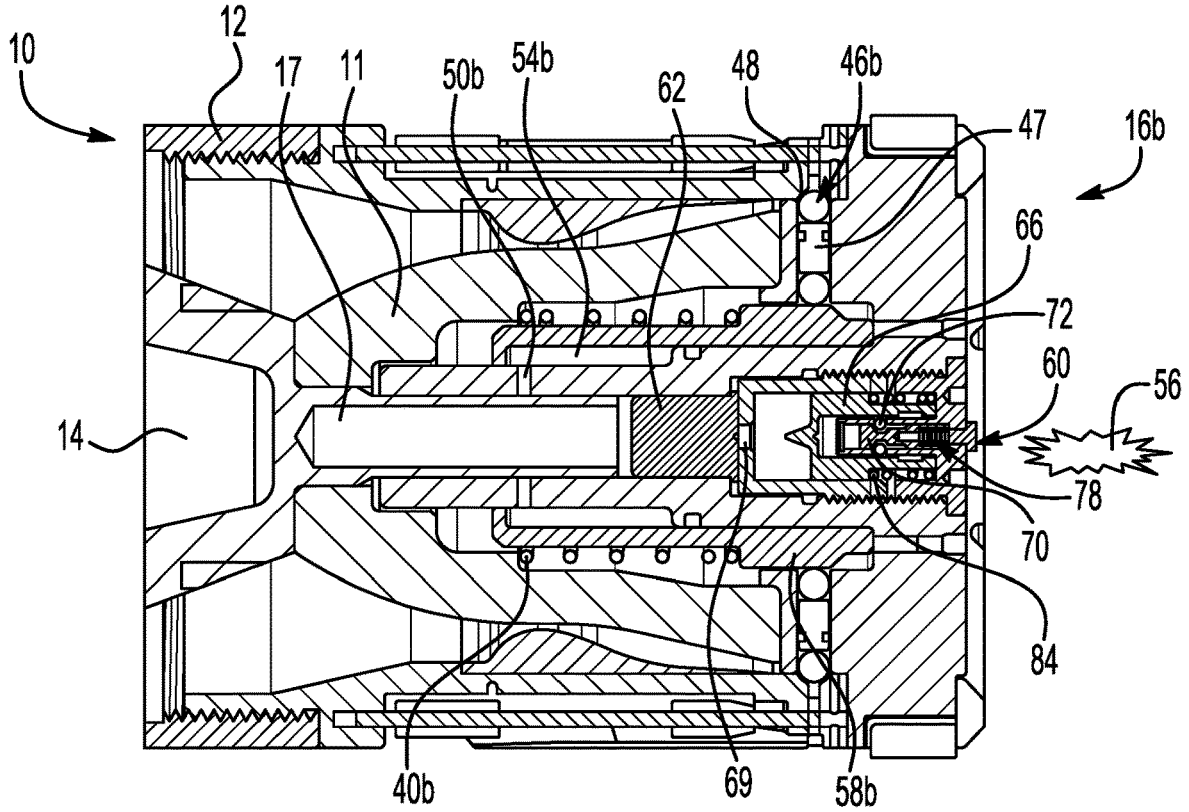
FIG. 10C is a partial cross-sectional view of the extended range projectile having the pusher plate assembly of FIGS. 7A-8 after the gun is fired and before the projectile exits the barrel of the gun, with the firing pin assembly in the unlocked position and a firing pin of the firing pin assembly in a cocked position.
Figure 10D:
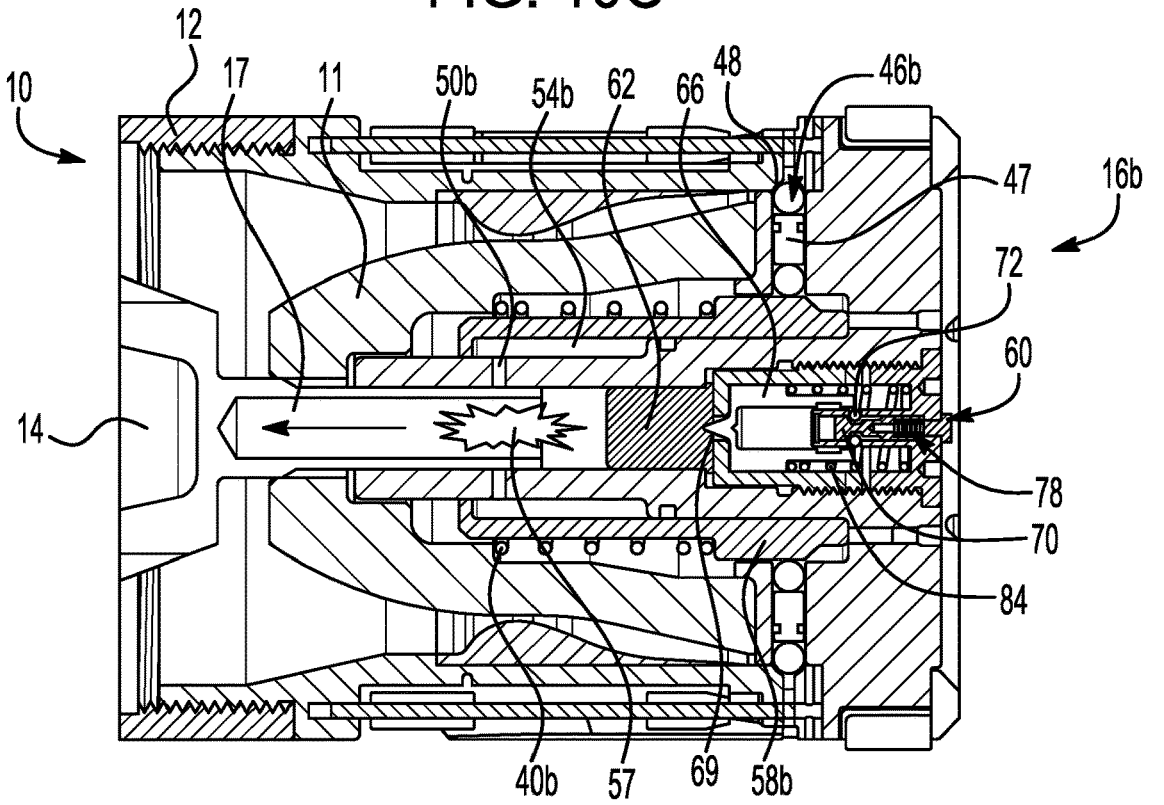
FIG. 10D is a partial cross-sectional view of the extended range projectile having the pusher plate assembly of FIGS. 7A-8 after the projectile first exits the barrel of the gun and the firing pin is in the striking position.
Figure 10E:
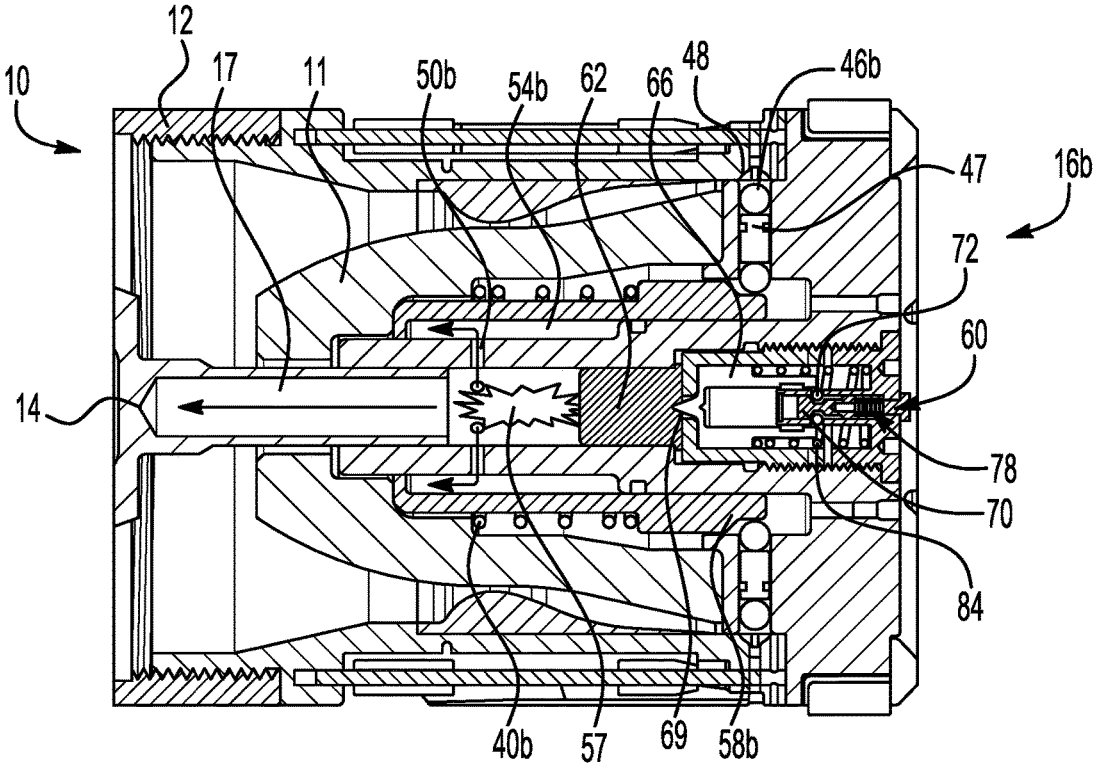
FIG. 10E is a partial cross-sectional view of the extended range projectile having the pusher plate assembly of FIGS. 7A-8 after the projectile exits the barrel of the gun and the pusher plate assembly is unlocked from the aft end of the outer shell.
Figure 10F:
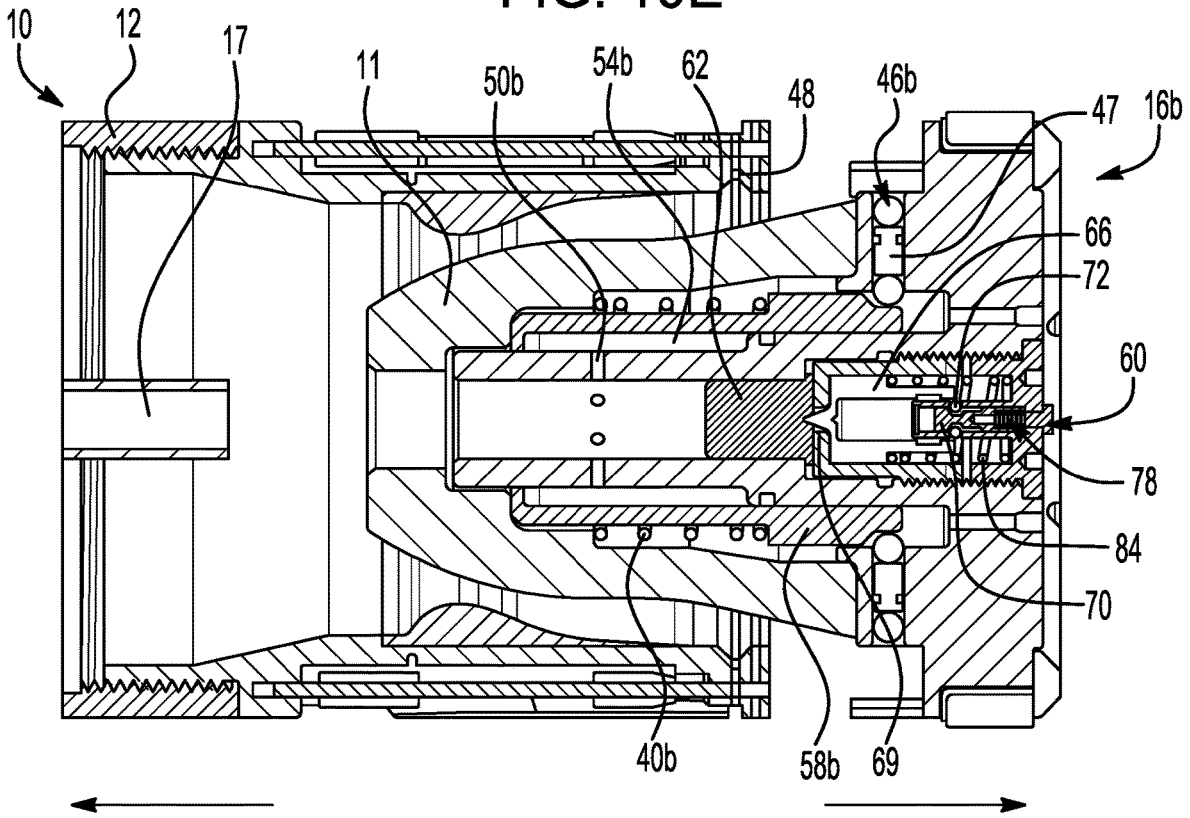
FIG. 10F is a partial cross-sectional view of the extended range projectile having the pusher plate assembly of FIGS. 7A-8 after the projectile exits the barrel of the gun and the pusher plate assembly is separated from the aft end of the outer shell.

When the firing pin locking assembly 64 is in the firing pin unlocked position (FIGS. 10B-F), the firing pin 66 is moveable from an inert position (FIGS. 9, 10A and 10B) to a cocked position (FIG. 10C), and from the cocked position (FIG. 10C) to a striking position (FIGS. 10D-F). Specifically, when the firing pin lock piston 70 is in the second position and the firing pin lock 72 is arranged in the firing pin lock piston notch 76, the firing pin 66 is configured to axially move relative to the firing pin lock piston 70. The firing pin 66 is biased in the inert position with a firing pin biasing member 84. The firing pin biasing member 84 may be, for example, a spring.

As described above with reference to the first embodiment of the pusher plate assembly 16*a*, the cylindrical pusher plate piston 20*b* of the second embodiment of the pusher plate assembly 16*b* is axially moveable from a locking position (FIGS. 10A-D) to an unlocking position (FIGS. 10E-F). The cylindrical pusher plate piston 20*b* includes a pusher plate piston biasing member 40*b* configured to bias the pusher plate piston 20*b* in the locking position (FIGS. 10A-D). The pusher plate piston biasing member 40*b* may be, for example a spring. The pusher plate piston biasing member 42*b* may be supported by the pusher plate support 11, as depicted in FIG. 8.

The locking assembly 24*b* of the pusher plate assembly 16*b* is configured to variably lock the pusher plate assembly 16*b* to the aft end of the outer shell 12. Specifically, the locking assembly 24*b* is radially moveable from a locked position (FIGS. 10A-D) to an unlocked position (FIGS. 10E-F) when the cylindrical pusher plate piston 20*b* is in the unlocking position (FIGS. 10E-F). For example, the locking assembly 24*b* may include a plurality of slidable locks 46*b* arranged circumferentially around and extending radially outward from the cylindrical pusher plate piston 20*b*. In the locked position of the locking assembly 24*b* (FIGS. 10A-D), the plurality of slidable locks 46*b* are engaged with the locking recess 48 in the aft end of the outer shell 12, thereby locking the pusher plate assembly 16*b* to the outer shell 12. In the unlocked position (FIGS. 10E-F), the plurality of slidable locks 46*b* are disengaged with the locking recess 48 in the aft end of the outer shell 12, thereby unlocking the pusher plate assembly 16*b* from the outer shell 12. The plurality of slidable locks 46*b* may be, for example, a plurality of ball stack locks, as depicted. The plurality of ball stack locks may include a plurality of balls with or without a cylinder 47 disposed between a first end ball and a second end ball. The particular types of slidable locks 46*b* described herein are provided as non-limiting examples, and it is understood that other types of slidable locks may be applicable to the locking assembly 24*b* disclosed herein.

The hollow pusher plate barrel 22*b* of the pusher plate assembly 16*b* includes a plurality of ports 50*b* extending through a wall of the hollow pusher plate barrel 22*b* from an inner barrel chamber 52*b* of the hollow pusher plate barrel 22*b* to an outer piston chamber 54*b* formed by an inner wall of the cylindrical pusher plate piston 20*b* and an outer wall of the hollow pusher plate barrel 22*b*. That is, the cylindrical pusher plate piston 20*b* is configured to be spaced apart from the hollow pusher plate barrel 22*b* disposed concentrically therewithin at least in an area immediately surrounding the plurality of ports 50*b*. The cylindrical pusher plate piston 20*b*, however, is fixed to and contacts the outer wall of the hollow pusher plate barrel 22*b* on a first side of the plurality of ports 50*b* and on a second side of the plurality of ports 50*b*, such that the outer piston chamber 54*b* is formed where the cylindrical pusher plate piston 20*b* is spaced apart from the hollow pusher plate barrel 22*b*, around the plurality of ports 50*b*.

Operation of the second embodiment of the pusher plate piston 16*b* will now be described with reference to sequential FIGS. 10A-F. FIG. 10A depicts the arrangement of the extended range projectile 10 having the center projectile body 14 in its stowed position as the projectile 10 is being transported, handled and loaded into the gun prior to firing the gun. In this position, the hollow pusher piston 17 of the center projectile body 14 extends concentrically into the hollow pusher plate barrel 22*b* of the pusher plate assembly 16*b*, covering and blocking the plurality of ports 50*b*. The firing pin locking assembly 64 of the firing pin assembly 60 is in the firing pin locked position. That is, the firing pin lock piston 70 of the firing pin locking assembly 64 is in the first position, being biased in the first position with the firing pin lock piston biasing member 78. Thus, the firing pin lock 72 is engaged with the firing pin locking notch 74 in the firing pin 66. Also, the firing pin 66 is in the inert position, being biased in the inert position by the firing pin biasing member 84. Additionally, the pusher plate piston 16*b* is locked to the aft end of the outer shell 12 of the extended range projectile 10. That is, the cylindrical pusher plate piston 20*b* is in the locking position, being biased in the locking position by the pusher plate piston biasing member 40*b*, and the plurality of slidable locks 46*b* are engaged with the locking recess 48 in the aft end of the outer shell 12.

FIG. 10B depicts the arrangement of the extended range projectile 10 when the gun from which it is configured to be projected is fired. When the gun is fired, the gunfire pressure 56 is created in the barrel 15 of the gun. The setback force within the barrel 15 of the gun causes the firing pin locking assembly 64 of the firing pin assembly 60 to move from the firing pin locked position to the firing pin unlocked position. Specifically, the setback force overcomes the biasing force of the firing pin lock piston biasing member 78 such that the firing pin lock piston biasing member 78 is compressed and the firing pin lock piston is moved from the first position to the second position and the firing pin lock is disengaged with the firing pin locking notch 74 in the firing pin 66. With the firing pin locking assembly 64 in the firing pin unlocked position, the firing pin 66 is free to move from the inert position to the cocked position. Accordingly, thereafter, as depicted in FIG. 10C, the setback force causes the firing pin 66 to move from the inert position to the cocked position. Specifically, the setback force is sufficient to overcome the biasing force of the firing pin biasing member 84 such that the firing pin biasing member 84 is compressed and the firing pin 66 moves to the cocked position.

FIG. 10D depicts the arrangement of the extended range projectile 10 as soon as the aft end of the projectile 10 exits the barrel 15 of the gun. As soon as the aft end of the projectile exits the barrel 15 of the gun, the setback force is removed and biasing force of the firing pin biasing member 84 forces the firing pin 66 from the cocked position to the striking position, in which the firing pin 66 strikes the energetic cartridge 62 through the firing pin hole 69. When the firing pin 66 strikes the energetic cartridge 62, the energetic cartridge 62 is configured to generate a pressurized gas 57 into the hollow pusher piston 17 of the center projectile body 14 arranged concentrically in the hollow pusher plate barrel 22*b* of the pusher plate assembly 16*b*. The pressurized gas 57 exerts a force that is sufficient to begin to move the center projectile body 14 from the stowed position toward the deployed position. Once the hollow pusher piston 17 is moved far enough to expose the plurality of ports 50*b* in the hollow pusher plate barrel 22*b*, as depicted in FIG. 10E, the plurality of ports 50*b* are configured to permit the pressurized gas 57 to move from the inner barrel chamber 52*b* of the hollow pusher plate barrel 22*b* to the outer piston chamber 54*b*. The pressurized gas 57 in the outer piston chamber 54*b* is sufficient to move the cylindrical pusher plate piston 20*b* from the locking position (FIGS. 10A-D) to the unlocking position (FIGS. 10E-F). Specifically, the pressurized gas 57 is sufficient to overcome the biasing force of the pusher plate piston biasing member 40*b* such that the spring 42*b* of the pusher plate biasing member 40*b* is compressed and the cylindrical pusher plate piston 20*b* moves from the locking position to the unlocking position.

When the cylindrical pusher plate piston 20*b* is in the unlocking position, the locking assembly 24*b* is configured to move from the locked position (FIGS. 10A-D) to the unlocked position (FIGS. 10E-F). Specifically, the cylindrical pusher plate piston 20*b* includes a stepped projection 58*b* extending radially outward from the cylindrical pusher plate piston 20*b*. In the locking position of the cylindrical pusher plate piston 20*b*, the stepped projection 58*b* supports the plurality of slidable locks 46*b* of the locking assembly 24*b* in the locked position, in which the plurality of slidable locks 46*b* are engaged with the locking notch 48 in the outer shell 12. However, when the cylindrical pusher plate piston 20*b* is moved from the locking position to the unlocking position, the stepped projection 58*b* moves and no longer supports the plurality of slidable locks 46*b* of the locking assembly 24*b* in the locked position. The plurality of slidable locks 46*b* are therefore free to move from the locked position to the unlocked position, in which the plurality of slidable locks 46 are disengaged with the locking notch 48 of the outer shell 12, as depicted in FIG. 10E.

Accordingly, as depicted in FIG. 10F, the pusher plate assembly 16*b* is unlocked from the aft end of the outer shell 12 and separates from the aft end of the outer shell 12, as the pressurized gas moves the center projectile body 14 fully to the deployed position and further propels the center projectile body 14 and the outer shell 12 of the projectile 10. Once the pusher plate assembly 16*b* is separated from the aft end of the outer shell 12, the projectile 10 transforms to its flight state, in which one or more fins 19 are deployed, as previously depicted in FIG. 6F.

Figure 11:
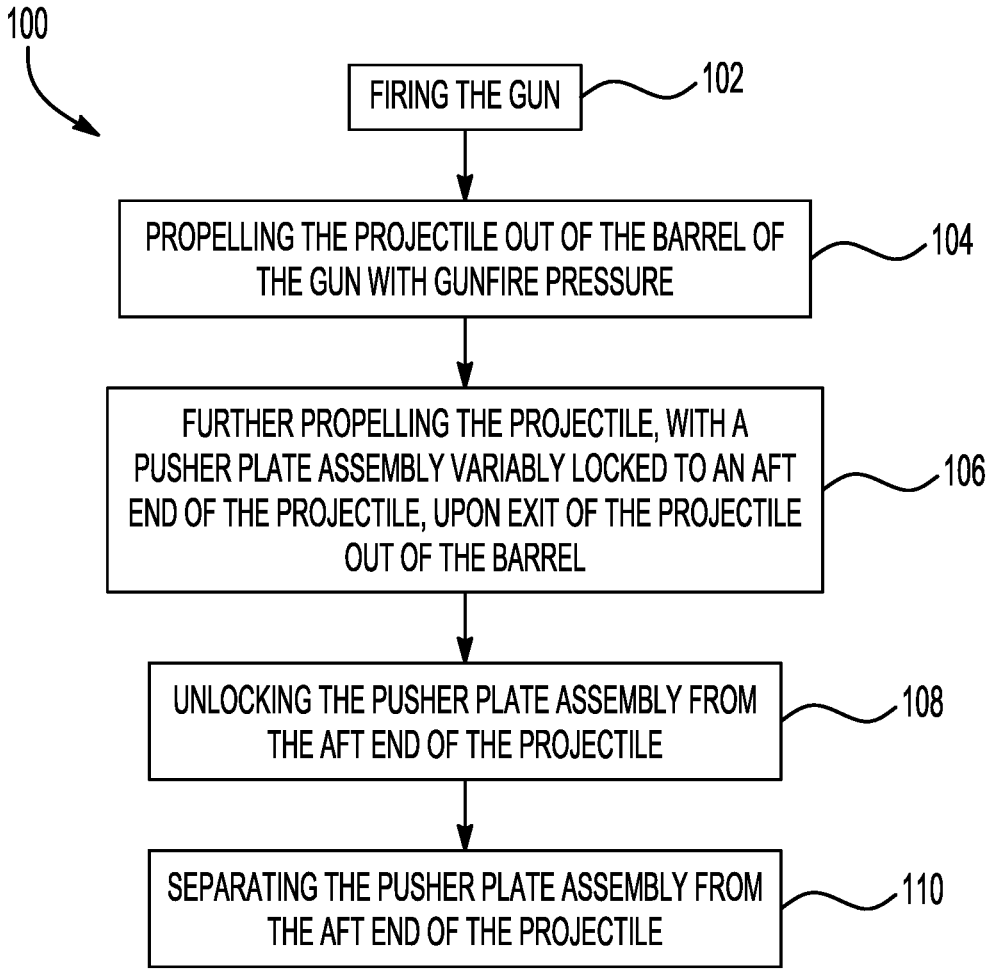
FIG. 11 is a flowchart of a method of propelling an extended range projectile from a barrel of a gun.

A method 100 of propelling an extended range projectile from a barrel of a gun is depicted in FIG. 11. The method 100, for example, may be used to propel the extended range projectile 10 described herein. The method 100 includes a step 102 of firing the gun and a step 104 of propelling the projectile out of the barrel of the gun with gunfire pressure created in the barrel upon firing the gun. The method 100 then includes the step 106 of further propelling the projectile, with a pusher plate assembly variably locked to an aft end of the projectile, upon exit of the projectile out of the barrel. The method 100 then includes the step 108 of unlocking the pusher plate assembly from the aft end of the projectile and a step 110 of separating the pusher plate assembly from the aft end of the projectile.

The pusher plate assembly of the projectile may be either one of the pusher plate assembly 16*a* or the pusher plate assembly 16*b* described herein. Accordingly, in one embodiment, for example when the pusher plate assembly is the pusher plate assembly 16*a* described herein, the step 106 of further propelling the projectile with the pusher plate assembly includes the step of moving a check valve disposed at an aft end of the pusher plate assembly from a closed position to an open position to permit the gunfire pressure to enter the pusher plate assembly and propel the extended range projectile. The check valve may be the same as the check valve 26 described herein with reference to the pusher plate assembly 16*a*. Accordingly, the step of moving the check valve and the sequence of events occurring thereafter may follow that as previously described with reference to the operation of the pusher plate assembly 16*a* above. Specifically, the step 108 of unlocking the pusher plate assembly may include moving a cylindrical pusher plate piston, such as the cylindrical pusher plate piston 20*a*, from a locking position to an unlocking position, and moving a locking assembly, such as the locking assembly 24*a*, from a locked position to an unlocked position, as fully described above with reference to the operation of the pusher plate assembly 16*a*.

In another embodiment, for example when the pusher plate assembly is the pusher plate assembly 16*b* described herein, the step 106 of further propelling the projectile with the pusher plate assembly includes the steps of striking an energetic cartridge of the pusher plate assembly with a firing pin of the pusher plate assembly and generating a pressurized gas from the energetic cartridge to propel the extended range projectile. The energetic cartridge and the firing pin may be the same as the energetic cartridge 62 and the firing pin 66 described above with reference to the pusher plate assembly 16*b*. Accordingly, the step of striking the energetic cartridge may include moving a firing pin locking assembly, such as the firing pin locking assembly 64, from a firing pin locking position to a firing pin unlocking position, and moving the firing pin, such as the firing pin 66, from an inert position to a cocked position, as fully described above with reference to the operation of the pusher plate assembly 16*b*. The step of striking the energetic cartridge may then include moving the firing pin from the cocked position to the striking position, as also fully described above with reference to the operation of the pusher plate assembly 16*b*. The steps of generating the pressurized gas from the energetic cartridge and the sequence of events occurring thereafter may follow that as previously described with reference to the operation of the pusher plate assembly 16*b* above. Specifically, the step 108 of unlocking the pusher plate assembly may include moving a cylindrical pusher plate piston, such as the cylindrical pusher plate piston 20*b*, from a locking position to an unlocking position, and moving a locking assembly, such as the locking assembly 24*b*, from a locked position to an unlocked position, as fully described above with reference to the operation of the pusher plate assembly 16*b*.

Although the above disclosure has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments. In addition, while a particular feature may have been described above with respect to only one or more of several illustrated embodiments, such feature may be combined with one or more other features of the other embodiments, as may be desired and advantageous for any given or particular application.

What is claimed is:

1. An extended range projectile, comprising:

an outer shell;

a center projectile body axially moveable from a stowed position to a deployed position within the outer shell; and a pusher plate assembly variably locked to an aft end of the outer shell, the pusher plate assembly including a check valve disposed at an aft end of the pusher plate assembly, the check valve being moveable from a closed position to an open position;

wherein in the open position of the check valve, the check valve is configured to permit entry of a gunfire pressure, created in a barrel of a gun from which the extended range projectile is configured to be projected, into the pusher plate assembly such that, when the extended range projectile exits the barrel, the gunfire pressure moves the center projectile body from the stowed position to the deployed position and propels the extended range projectile.

2. The extended range projectile of claim 1, wherein the pusher plate assembly further includes:

a cylindrical pusher plate piston axially moveable from a locking position to an unlocking position;

a hollow pusher plate barrel arranged concentrically within the cylindrical pusher plate piston;

a locking assembly configured to variably lock the pusher plate assembly to the aft end of the outer shell, the locking assembly being radially moveable from a locked position to an unlocked position when the cylindrical pusher plate piston is in the unlocking position.

3. The extended range projectile of claim 2, wherein the cylindrical pusher plate piston includes a pusher plate piston biasing member configured to bias the pusher plate piston in the locking position.

4. The extended range projectile of claim 2, wherein the check valve is disposed within the hollow pusher plate barrel at an aft end of the hollow pusher plate barrel.

5. The extended range projectile of claim 2, wherein the locking assembly includes a plurality of slidable locks arranged circumferentially around and extending radially outward from the cylindrical pusher plate piston, wherein:

in the locked position, the plurality of slidable locks are engaged with a locking recess in the aft end of the outer shell, thereby locking the pusher plate assembly to the outer shell; and in the unlocked position, the plurality of slidable locks are disengaged with the locking recess in the aft end of the outer shell, thereby unlocking the pusher plate assembly from the outer shell.

6. The extended range projectile of claim 5, wherein the plurality of slidable locks include a plurality of ball stack locks.

7. The extended range projectile of claim 2, wherein the center projectile body includes a hollow pusher piston extending axially from an aft end of the center projectile body into the hollow pusher plate barrel of the pusher plate assembly.

8. The extended range projectile of claim 2, wherein the hollow pusher plate barrel includes a plurality of ports extending through a wall of the hollow pusher plate barrel from an inner barrel chamber of the hollow pusher plate barrel to an outer piston chamber formed by an inner wall of the cylindrical pusher plate piston and an outer wall of the hollow pusher plate barrel.

9. The extended range projectile of claim 1, wherein the check valve includes a valve piston, a valve seat, and a valve piston biasing member configured to bias the check valve in the closed position in which the valve piston contacts the valve seat.

10. An extended range projectile, comprising:

an outer shell;

a center projectile body axially moveable from a stowed position to a deployed position within the outer shell; and a pusher plate assembly variably locked to an aft end of the outer shell, the pusher plate assembly including a firing pin assembly and an energetic cartridge;

wherein, when the extended range projectile exits a barrel of a gun from which the extended range projectile is configured to be projected, the firing pin assembly is configured to strike the energetic cartridge; and wherein, when the firing pin assembly strikes the energetic cartridge, the energetic cartridge is configured to generate a pressurized gas to move the center projectile body from the stowed position to the deployed position and propel the extended range projectile.

11. The extended range projectile of claim 10, wherein the pusher plate assembly further includes:

a cylindrical pusher plate piston axially moveable from a locking position to an unlocking position;

a hollow pusher plate barrel arranged concentrically within the cylindrical pusher plate piston;

a locking assembly configured to variably lock the pusher plate assembly to the aft end of the outer shell, the locking assembly being radially moveable from a pusher plate locked position to a pusher plate unlocked position when the cylindrical pusher plate piston is in the unlocking position.

12. The extended range projectile of claim 10, wherein the firing pin assembly includes:

a firing pin locking assembly moveable from a firing pin locked position to a firing pin unlocked position; and a firing pin moveable, when the firing pin locking assembly is in the unlocked position, from an inert position to a cocked position and from the cocked position to a striking position.

13. The extended range projectile of claim 12, wherein the firing pin locking assembly includes:

a firing pin lock piston moveable from a first position to a second position; and a firing pin lock, wherein:

in the firing pin locked position, the firing pin lock piston is in the first position and the firing pin lock is engaged with a firing pin locking notch in the firing pin, in the firing pin unlocked position, the firing pin lock piston is in the second position and the firing pin lock is disengaged with the firing pin locking notch in the firing pin.

14. The extended range projectile of claim 13, wherein the firing pin lock piston is biased in the first position with a firing pin lock piston biasing member.

15. The extended range projectile of claim 11, wherein the center projectile body includes a hollow pusher piston extending axially from an aft end of the center projectile body into the hollow pusher plate barrel of the pusher plate assembly.

16. The extended range projectile of claim 11, wherein the hollow pusher plate barrel includes a plurality of ports extending through a wall of the hollow pusher plate barrel from an inner barrel chamber of the hollow pusher plate barrel to an outer piston chamber formed by an inner wall of the cylindrical pusher plate piston and an outer wall of the hollow pusher plate barrel.

17. The extended range projectile of claim 11, wherein the energetic cartridge is disposed within the hollow pusher plate barrel.

* * * * *